US008269086B1

(12) United States Patent
Tanabe

(10) Patent No.: US 8,269,086 B1
(45) Date of Patent: Sep. 18, 2012

(54) FLUTE SUPPORT

(76) Inventor: Yuichi Tanabe, Red Hook, NY (US)

( * ) Notice: Subject to any disclaimer, the term of this patent is extended or adjusted under 35 U.S.C. 154(b) by 12 days.

(21) Appl. No.: 13/052,063

(22) Filed: Mar. 19, 2011

(51) Int. Cl.
*G10D 7/02* (2006.01)

(52) U.S. Cl. ..... 84/384; 84/380 R; 84/380 C; 84/327; 84/322; 84/329

(58) Field of Classification Search ..... 84/384, 84/380 R, 380 C, 327, 322, 329
See application file for complete search history.

(56) References Cited

U.S. PATENT DOCUMENTS

| | | | | | |
|---|---|---|---|---|---|
| 444,830 | A | * | 1/1891 | Guenther | 84/384 |
| 1,166,971 | A | * | 1/1916 | Conn | 84/380 R |
| 1,258,077 | A | * | 3/1918 | Worcester | 446/26 |
| 2,039,985 | A | * | 5/1936 | Smullin | 84/267 |
| 2,803,983 | A | * | 8/1957 | Dowling | 84/382 |
| 2,847,892 | A | * | 8/1958 | Laas et al. | 84/380 R |
| 2,933,968 | A | * | 4/1960 | Hearne, Jr. | 84/380 R |
| D210,851 | S | * | 4/1968 | Wallace | D17/20 |
| 3,847,051 | A | * | 11/1974 | Miller | 84/387 A |
| 3,988,958 | A | * | 11/1976 | Brunkow | 84/453 |
| 4,348,935 | A | * | 9/1982 | Bay | 84/380 R |
| 4,763,556 | A | * | 8/1988 | Peplowski | 84/384 |
| 5,025,699 | A | * | 6/1991 | Toyama | 84/453 |
| D339,601 | S | * | 9/1993 | Diefes | D17/13 |
| 5,553,529 | A | * | 9/1996 | Smith | 84/453 |
| 5,973,243 | A | * | 10/1999 | Christenson | 84/322 |
| 6,037,533 | A | * | 3/2000 | Runyon | 84/385 R |
| D427,228 | S | * | 6/2000 | Light | D17/10 |
| 6,416,379 | B1 | * | 7/2002 | Topman | 446/204 |
| D464,985 | S | * | 10/2002 | Plovanich | D17/13 |
| 6,759,584 | B2 | * | 7/2004 | Sundstrom | 84/469 |
| 7,161,076 | B2 | * | 1/2007 | Lin | 84/380 R |
| 7,396,985 | B1 | * | 7/2008 | Roth | 84/387 A |
| 7,435,889 | B1 | * | 10/2008 | Heidt | 84/422.4 |
| 7,799,979 | B2 | * | 9/2010 | Swartz | 84/322 |
| 7,977,557 | B2 | * | 7/2011 | Broderick | 84/322 |
| 2002/0178891 | A1 | * | 12/2002 | Atkin | 84/322 |
| 2006/0086231 | A1 | * | 4/2006 | Sielaff | 84/322 |
| 2007/0044635 | A1 | * | 3/2007 | Lee | 84/384 |

* cited by examiner

*Primary Examiner* — David Warren
*Assistant Examiner* — Robert W Horn
(74) *Attorney, Agent, or Firm* — Law Offices of Michael L.Wise, LLC

(57) ABSTRACT

An apparatus is worn on a finger of a user while playing the flute. The apparatus comprises a stabilization pad, an inner support pad, and an outer support pad. The stabilization pad is disposed at a first end of the apparatus and is positionable to abut at least one of the finger and a palm of the user. In contrast, the outer support pad is disposed at a second end of the apparatus and is positionable to project outward from the finger of the user. The inner support pad and the outer support pad are operative to at least partially support the flute.

19 Claims, 3 Drawing Sheets

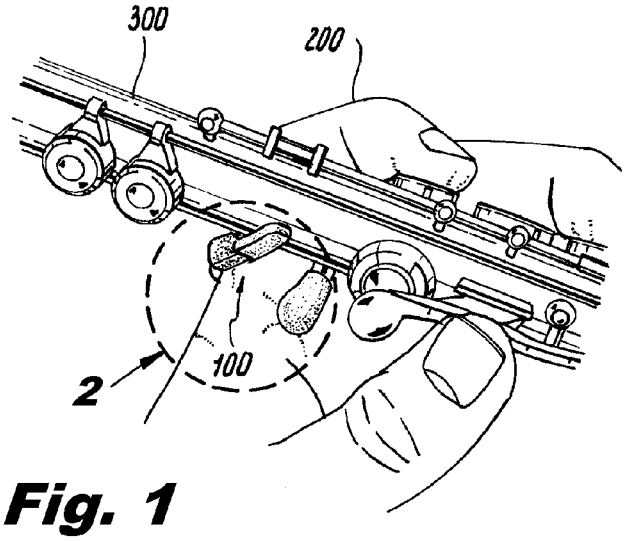
Fig. 1
Fig. 2
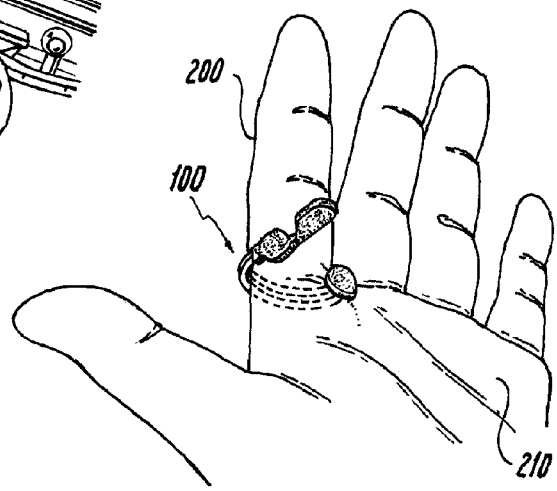
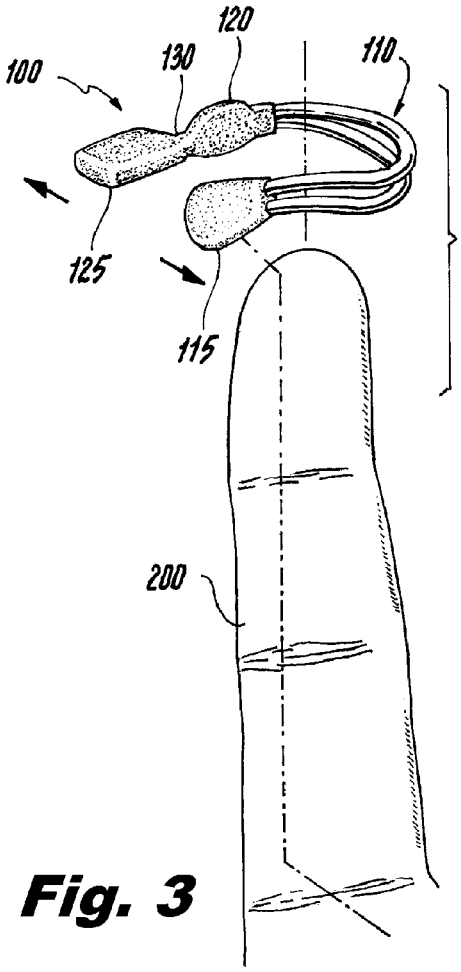
Fig. 3
Fig. 4
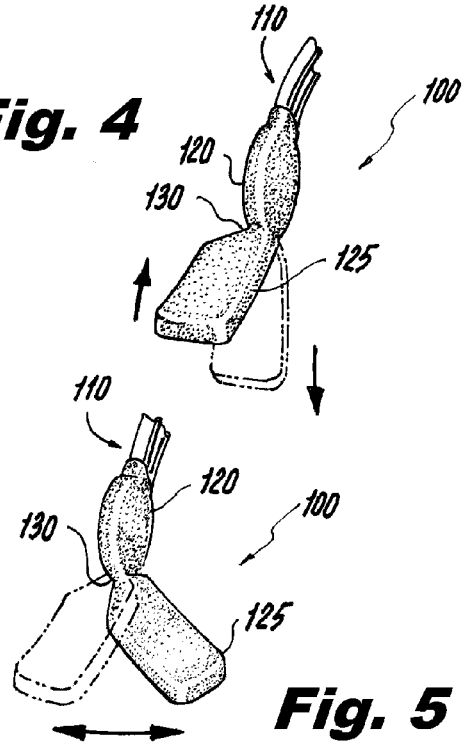
Fig. 5

FLUTE SUPPORT

FIELD OF THE INVENTION

The present invention relates generally to accessories for musical instruments, and, more particularly, to accessories for use while playing a flute.

BACKGROUND OF THE INVENTION

A Western concert flute is a side-blown flute, meaning that the player blows directly across the edge of a mouthpiece while the remainder of the flute's tubular body is held transverse to the player's body. The air stream across the mouthpiece creates a Bernoulli Effect that excites the air contained in the tubular body. The player changes the pitch of the sound by opening and closing holes in the body of the instrument, thus changing the effective length of a resonator and its corresponding resonant frequency. By varying the air pressure, a flute player can also change the pitch of a note by causing the air in the flute to resonate at a harmonic other than the fundamental frequency without opening or closing any holes.

While playing a flute, a player utilizes all the player's fingers except the right thumb to operate the keys of the instrument. For support, the flute rests on the root of the player's left index finger and on the player's right thumb. Unfortunately, this arrangement is not particularly stable. If the flute is not adequately supported, the pressure on the mouthpiece may cause the flute to rotate about its longitudinal axis. Likewise, that same pressure may try to twist the flute so that its distal end moves towards the player's body. Each of these effects may become more pronounced when the player's hands become sweaty due to, for example, the stress of a performance. Under extreme conditions, the flute may even slip away entirely and the player may lose the player's hand position.

An attempt to address the problem of adequately supporting a flute while playing that instrument can be found in U.S. Patent Publication No. 2007/0044635 (now abandoned) to Lee, entitled "Flute Attachment." This solution utilizes a "securing member" that is attached to the flute's body and against which a player may rest the player's right thumb when playing the instrument. Nevertheless, such a solution relies on attaching the securing member directly to the flute's tubular body. Attachment can be by clamping, bonding, or threading. There is, as a result, strong concern that such an attachment will affect the resonant qualities of the flute and thereby change its sound. Such an attachment may also limit the freedom of movement of the flute player's thumb, which consequently restricts the hand position and makes it uncomfortable and more difficult to play the flute. Lastly, there is a concern that such a solution may actually damage the instrument. Accordingly, while such a solution may be effective in helping to stabilize the flute, it is far from ideal.

For the foregoing reasons, there is a need for alternative means of supporting a flute while playing that instrument. Ideally, such a solution will not substantially affect the sound of the flute, will not damage the flute, and will accommodate flute players with different sized hands.

SUMMARY OF THE INVENTION

Embodiments of the present invention address the above-identified needs by providing apparatus capable of supporting a flute while that instrument is being played.

In accordance with an aspect of the invention, an apparatus is worn on a finger of a user while playing the flute. The apparatus comprises a stabilization pad, an inner support pad, and an outer support pad. The stabilization pad is disposed at a first end of the apparatus and is positionable to abut at least one of the finger and a palm of the user. In contrast, the outer support pad is disposed at a second end of the apparatus and is positionable to project outward from the finger of the user. The inner support pad and the outer support pad are operative to at least partially support the flute.

In accordance with an additional aspect of the invention, a method to be used by a user in playing a flute comprises receiving an apparatus, the apparatus comprising a stabilization pad, an inner support pad, and an outer support pad, the stabilization pad disposed at a first end of the apparatus and the outer support pad disposed at a second end of the apparatus. The apparatus is then placed on the finger of the user such that the stabilization pad abuts at least one of the finger and a palm of the user while the outer support pad projects outward from the finger of the user. The user then plays the flute while at least partially supporting the flute with the inner support pad and the outer support pad.

Advantageously, embodiments of the invention allow a flute player to more securely hold a flute while, at the same time, leaving the flute player's fingers free to operate the flute in a conventional manner and without an awkward hand position. The tendency of the flute to rotate about its longitudinal axis and the tendency of the flute's distal end to twist towards the player's body are both strongly suppressed. Playing the instrument becomes easier and concerns about losing finger position are mitigated.

BRIEF DESCRIPTION OF THE DRAWINGS

These and other features, aspects, and advantages of the present invention will become better understood with regard to the following description, appended claims, and accompanying drawings where:

FIG. 1 shows a perspective view of an apparatus in accordance with a first illustrative embodiment of the invention while being used to support a flute;

FIG. 2 shows a perspective view of the FIG. 1 apparatus on a flute player's finger;

FIG. 3 shows an exploded view of the FIG. 1 apparatus and the flute player's finger;

FIGS. 4 and 5 show perspective views of an end portion of the FIG. 1 apparatus and how that end portion allows the outer support pad to be twisted;

DETAILED DESCRIPTION OF THE INVENTION

Figure 6:
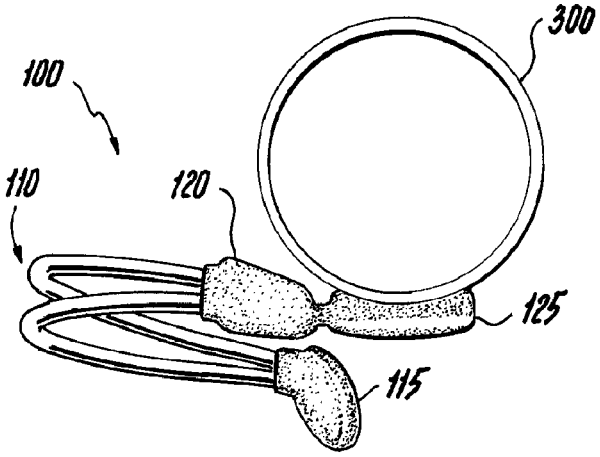
FIGS. 6 and 7 show perspective views of the FIG. 1 apparatus supporting a flute.

The present invention will be described with reference to illustrative embodiments. For this reason, numerous modifications can be made to these embodiments and the results will still come within the scope of the invention. No limitations with respect to the specific embodiments described herein are intended or should be inferred.

In addition, it should be noted that the word "flute" as used herein is intended to incorporate any musical instrument wherein the musician blows directly across the edge of the instrument's mouthpiece in order to produce sound. As used herein, the term "flute" therefore includes, but is not limited to, a Western concert flute, a piccolo, a fife, a dizi, a bansuri, and a fue.

FIGS. 1-7 show aspects of an apparatus 100 in accordance with a first illustrative embodiment of the invention. As indicated by these figures, the apparatus 100 is preferably worn on the left index finger 200 of a flute player while the flute player is playing a flute 300, and is designed to help the flute player support that instrument. The apparatus 100 defines a partial ring shape with exposed wires 110 constituting a large portion of the device. At a first end, the exposed wires 110 terminate in a stabilization pad 115. At a second, opposite end, the exposed wires 110 terminate in an inner support pad 120. The inner support pad 120, in turn, connects to an outer support pad 125 through a bendable joint 130.

The several pads 115, 120, 125 within the apparatus 100 serve specific functions. The stabilization pad 115 comprises a somewhat spherical portion that extends slightly downward with respect to the remainder of the apparatus 100. This spherical portion is positioned to abut the base of the flute player's index finger 200 and/or adjacent palm 210 when the apparatus 100 is in use. As the name would suggest, placement of the stabilization pad 115 against the finger 200 and/or palm 210 distributes the weight of the flute 300 on the flute player's finger 200 so that using the apparatus 100 remains comfortable and secure. It also inhibits the apparatus 100 from rotating on the player's finger 200 and from sliding upward from the base of the finger 200.

At the opposite end of the apparatus 100, both the inner support pad 120 and the outer support pad 125 are largely ovoid in shape, with the latter being slightly larger and flatter than the former. In use, the outer support pad 125 projects outward from the finger 200 of the flute player towards that player's face and has little or no contact with the player's finger 200. In contrast, the inner support pad 120 includes a surface that is positioned to abut the player's finger 200. The inner support pad 120 therefore helps distribute the weight of the flute 300 in a manner similar to the stabilization pad 115. In addition, the inner support pad 120 also helps in inhibiting unwanted movement of the apparatus 100 and ultimately the flute 300.

Figure 7:
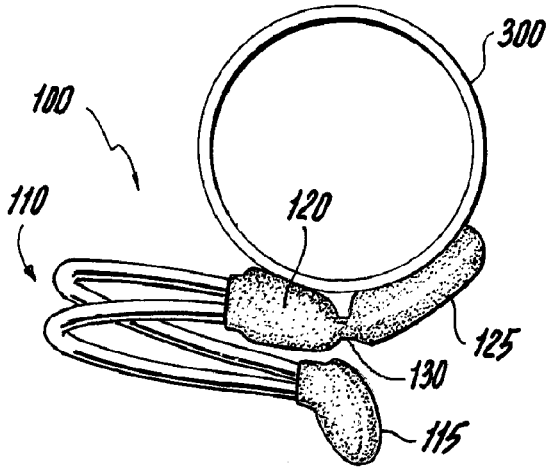

Configured in this manner, the inner support pad 120 and the outer support pad 125 act in cooperation to form a base onto which to rest the flute 300 while playing. For example, as shown in FIG. 7, the flute 300 may be rested on the apparatus 100 so that the flute's tubular body is approximately centered over the bendable joint 130. Alternatively, the flute may be rested on the outer support pad 125 alone, as shown in FIG. 6. In either case, supporting the flute 300 with the apparatus 100 provides several advantages to the flute player. It transfers a substantial amount of the weight of the flute 300 to the apparatus 100, thereby providing superior support to the instrument while, at the same time, leaving the flute player's fingers free to operate the flute 300 in a conventional manner and without an awkward hand position. Moreover, the tendency of the flute 300 to rotate about its longitudinal axis and the tendency of the flute's distal end to twist towards the player's body are both strongly suppressed. Playing the instrument becomes easier and concerns about losing finger position are also mitigated. The bendable joint 130 also allows the outer support pad 125 to be moved so it does not interfere with a trill key if the flute 300 is equipped with such a key (FIG. 5).

Once its unique structure and function are understood, the illustrative apparatus 100 may be formed with commercially available, off-the-shelf materials using conventional manufacturing techniques that will be familiar to a person having ordinary skill in the manufacturing arts. In the present embodiment, for example, a single span of metallic wire (e.g., coated aluminum wire) forms a skeleton that underlies the entire apparatus 100. Although not visible, wire loops underlie the stabilization pad 115 and the outer support pad 125, while two wire portions running substantially in parallel with one another form the exposed wires 110 and underlie the inner support pad 120. To create the three pads 115, 120, 125 themselves, epoxy resin is formed into the appropriate shape on the wire skeleton. The inner support pad 120 and the outer support pad 125 are subsequently coated with a rubber coating to form a non-slip surface on which the flute 300 will lie. The rubberized coating provides traction for the flute 300 and will not scratch the instrument.

While the apparatus 100 has some ability to accommodate different finger sizes due to the bendable nature of the exposed wires 110 (FIG. 3) and the bendable joint 130 (FIGS. 4 and 5), it has been empirically determined that differently sized apparatus 100 may be required to accommodate all the common finger sizes. A small size may, for example, accommodate flute players with index fingers 200 having diameters of 49.3-54.4 millimeters (mm), a medium size may accommodate flute players with index fingers 200 having diameters of 54.5-62.1 mm, and a large size may accommodate flute players with index fingers 200 having diameters of 62.2-69.7 mm. Making the apparatus 100 in different sizes is not considered particularly burdensome. Nevertheless, if a one-size-fits-all solution is desired instead, the next embodiment of the invention should also be considered.

Figure 8:
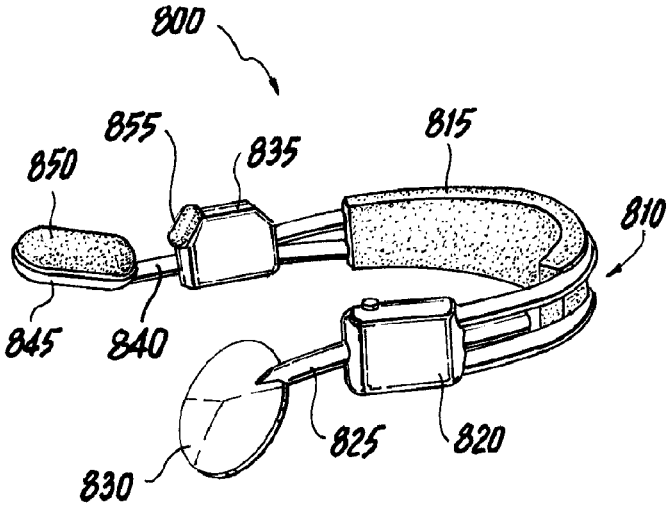
FIG. 8 shows a perspective view of an apparatus in accordance with a second illustrative embodiment of the invention.
Figure 9:
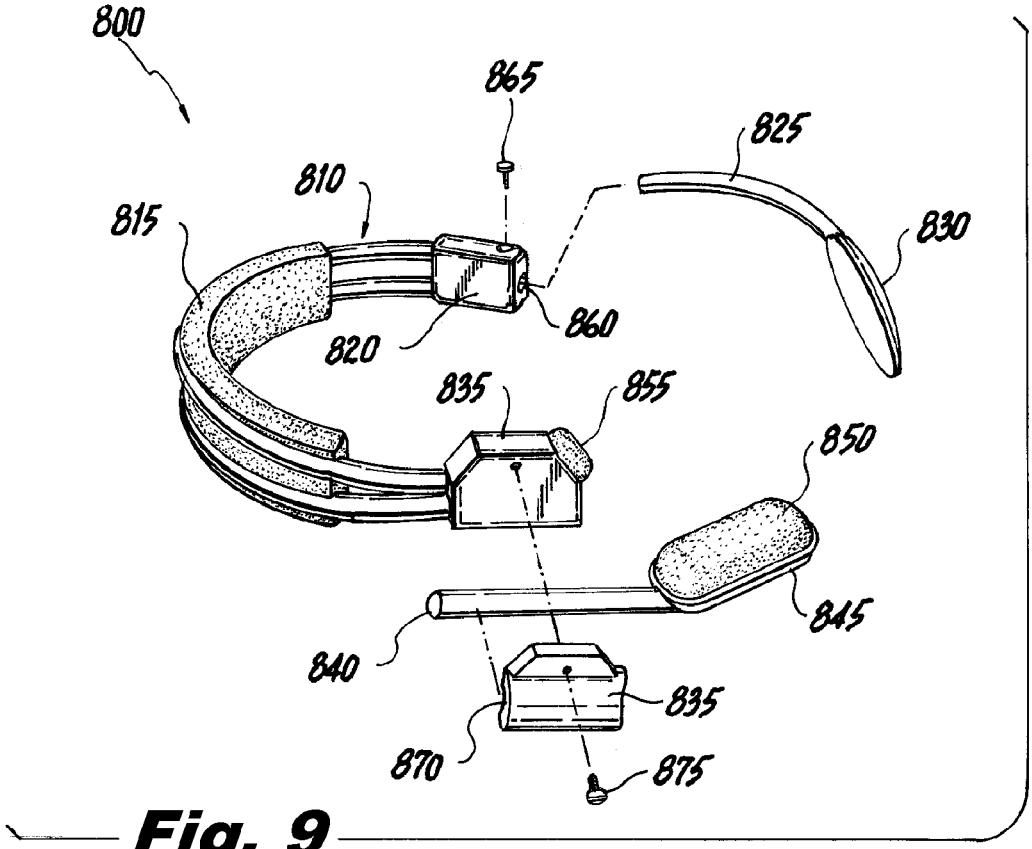
FIG. 9 shows an exploded view of the FIG. 8 apparatus.
Figure 10:
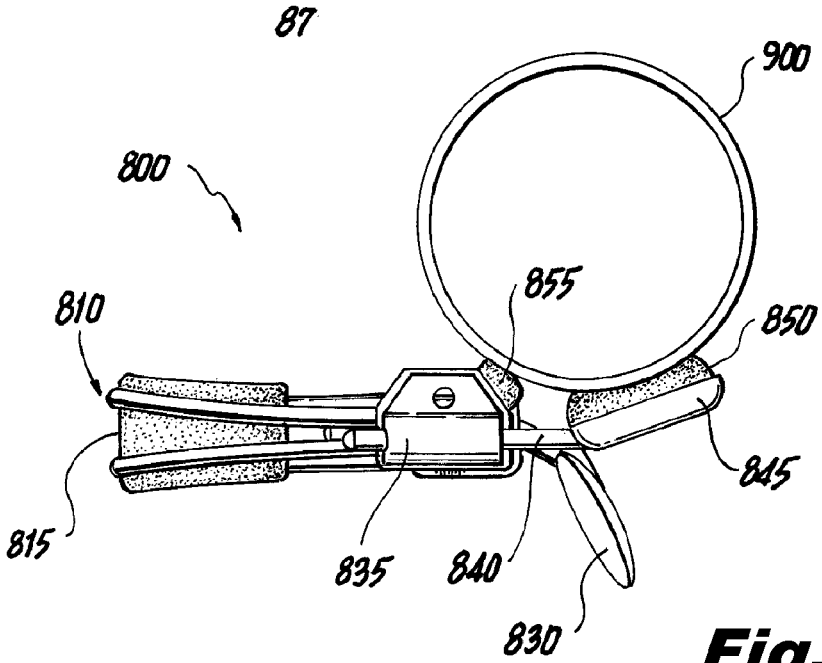
FIG. 10 shows a perspective view of the FIG. 8 apparatus supporting a flute.

FIGS. 8-10 go on to show an apparatus 800 in accordance with a second illustrative embodiment of the invention. The apparatus 800 describes a partial ring shape with exposed wires 810 constituting a large portion of the apparatus 800. The exposed wires 810 are partially covered by a ring cushion 815 that provides additional comfort to the wearer. At a first end, the exposed wires 810 terminate in a first rod holder 820. The first rod holder 820, in turn, supports a first rod 825 which is attached to a stabilization pad 830. At a second, opposite end, the exposed wires 810 terminate in a second rod holder 835. The second rod holder 835 is attached to a second rod 840 which terminates in a plate 845. This plate 845 underlies an outer support pad 850. The second rod holder 835 also includes an inner support pad 855.

The functions of the stabilization pad 830 and the outer support pad 850 in the apparatus 800 are similar to those of the stabilization pad 115 and the outer support pad 125 in the apparatus 100, namely, to distribute the weight of a flute 900 on the flute player's finger, to inhibit unwanted motion in the apparatus 800 and the flute 900, and to provide a base onto which to securely rest the flute 900 while playing that instrument. Nevertheless, the stabilization pad 830 and the outer support pad 850 in the apparatus 800 are afforded much greater adjustability than their respective counterparts in the apparatus 100, thereby allowing a single version of the apparatus 800 to be able to accommodate most, if not all, finger sizes.

The first rod holder 820, for example, supports the first rod 825 by providing a first channel 860 through which a portion of the first rod 825 passes. This first channel 860, in turn, allows the attached stabilization pad 830 to be both translated and rotated relative to the remainder of the apparatus 800. A first screw 865 provides a means of applying a compressive force to the first rod 825 so that it stays where desired once adjusted. Any excess portion of the first rod 825 that is disposed on the side of the first rod holder 820 opposite from the stabilization pad 830 runs between the two exposed wires 810 and thereby stays out of the way. Lastly, the first rod 825 is also manually bendable (i.e., bendable by hand without the use of tools), providing even finer adjustment of the relative position of the stabilization pad 830.

Accordingly, the flute player may simply loosen the first screw 865 and translate and rotate the first rod 825 until the stabilization pad 830 is in the desired location. At that point, the flute player may tighten the first screw 865 again to fix the position of the first rod 825 in the first rod holder 820. Any further fine adjustments, if required, may be accomplished by simply bending the first rod 825 itself.

At the opposite end of the apparatus 800, the outer support pad 850 may be adjusted in a similar manner. Here, the second rod holder 835 also supports the second rod 840 by providing a second channel 870 through which a portion of the second rod 840 passes, thereby allowing the attached outer support pad 850 to be both translated and rotated relative to the remainder of the apparatus 800. A second screw 875 provides a means of applying a compressive force to the second rod 840 so that it stays where desired once adjusted. Furthermore, the second rod 840 is manually bendable so that an even finer adjustment of the relative position of the outer support pad 850 is available. Once properly positioned, the outer support pad 850 in combination with the inner support pad 855 provide a stable base onto which to lay the flute 900, as shown in FIG. 10.

Nevertheless, unlike the first rod holder 820, the second channel 870 in the second rod holder 835 is not positioned in the center of the second rod holder 835, but is instead offset to one side. Such an arrangement causes any excess portion of the second rod 840 that is on the side of the second rod holder 835 opposite from the outer support pad 850 to not pass between the exposed wires 810, but to, instead, pass to the side of the exposed wires 810. This offset arrangement is preferable from the standpoint of properly positioning the outer support pad 850. Moreover, in the present embodiment, the second rod holder 835 is quite narrow where it meets the exposed wires 810 and, as a result, there is not sufficient room between the exposed wires 810 at this location to accommodate any excess portion of the second rod 840.

Like the apparatus 100, once the unique structure and function of the apparatus 800 is understood, it may be made from readily available materials using conventional manufacturing techniques by one having ordinary skill in the manufacturing arts. The exposed wires 810, the first rod holder 820, the first rod 825, the stabilization pad 830, the second rod holder 835, the second rod 840, and the plate 845 will preferably, for example, be made from metal, plastic, or a combination thereof. The ring cushion 815, the inner support pad 855, and the outer support pad 850 will preferably be made of a soft, spongy material such as, for example, silicone rubber, padded leather, or an equally suitable material.

It should again be emphasized that the above-described embodiments of the invention are intended to be illustrative only. Other embodiments can use different arrangements of elements for implementing the described functionality. For example, apparatus comprising pads with substantially different shapes from those described above would still fall within the scope of the invention. In addition, while each of the above-described embodiments includes two exposed wires, apparatus in accordance with aspects of the invention could have more than two exposed wires or may even replace the exposed wires with a strap. As a last example, while screws were used in the second illustrative embodiment to fix the first and second rods, other securing means could also be utilized such as springs or clips. These numerous alternative embodiments within the scope of the appended claims will be apparent to one skilled in the art.

Moreover, all the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

What is claimed is:

1. An apparatus, the apparatus, when worn on a finger of a user while playing a flute, comprising:

a stabilization pad, the stabilization pad disposed at a first end of the apparatus and positionable to abut at least one of the finger and a palm of the user;

an inner support pad; and an outer support pad, the outer support pad disposed at a second end of the apparatus and positionable to project outward from the finger of the user;

wherein the inner support pad and the outer support pad are operative to at least partially support the flute.

2. The apparatus of claim 1, further comprising two exposed wires disposed between the stabilization pad and the inner support pad.

3. The apparatus of claim 2, wherein the two exposed wires are at least partially covered by a cushion.

4. The apparatus of claim 1, wherein the inner support pad is positionable to abut the finger of the user.

5. The apparatus of claim 1, wherein the outer support pad is connected to the inner support pad through a bendable joint.

6. The apparatus of claim 1, wherein the stabilization pad is at least one of rotatable and translatable relative to the remainder of the apparatus.

7. The apparatus of claim 1, further comprising a first rod, the first rod operative to connect the stabilization pad to the remainder of the apparatus.

8. The apparatus of claim 7, wherein the first rod is manually bendable.

9. The apparatus of claim 7, further comprising two exposed wires, wherein at least a portion of the first rod runs between the two exposed wires.

10. The apparatus of claim 1, further comprising a first rod holder, the first rod holder operative to support the first rod.

11. The apparatus of claim 10, wherein the first rod holder supports the first rod by providing a channel through which a portion of the first rod passes.

12. The apparatus of claim 10, wherein the first rod holder supports the first rod at least in part by applying a compressive force to the first rod.

13. The apparatus of claim 1, wherein the outer support pad is at least one of rotatable and translatable relative to the remainder of the apparatus.

14. The apparatus of claim 1, further comprising a second rod, the second rod participating in connecting the outer support pad to the remainder of the apparatus.

15. The apparatus of claim 14, wherein the second rod is manually bendable.

16. The apparatus of claim 14, further comprising a second rod holder, the second rod holder operative to support the second rod.

17. The apparatus of claim 16, wherein the second rod holder supports the second rod by providing a channel through which a portion of the second rod passes.

18. The apparatus of claim 16, wherein the second rod holder supports the second rod at least in part by applying a compressive force to the second rod.

19. A method to be used by a user in playing a flute, the method comprising the steps of:

receiving an apparatus, the apparatus comprising a stabilization pad, an inner support pad, and an outer support pad, the stabilization pad disposed at a first end of the apparatus and the outer support pad disposed at a second end of the apparatus;

placing the apparatus on a finger of the user such that the stabilization pad abuts at least one of the finger and a palm of the user while the outer support pad projects outward from the finger of the user; and playing the flute while at least partially supporting the flute with the inner support pad and the outer support pad.

* * * * *